US005332161A

United States Patent [19]

Schweitzer et al.

[11] Patent Number: 5,332,161

[45] Date of Patent: Jul. 26, 1994

[54] BURNER NOZZLE ASSEMBLY

[75] Inventors: Ronald D. Schweitzer; Ludwig E. Schenk; David E. Shook, all of Mansfield, Ohio

[73] Assignee: Manasco, Inc., Mansfield, Ohio

[21] Appl. No.: 982,782

[22] Filed: Nov. 30, 1992

[51] Int. Cl.[5] ..... B05B 1/00

[52] U.S. Cl. ..... 239/600; 239/390; 239/553

[58] Field of Search ..... 239/600, 390, 550, 396, 239/591, 552, 602, 551, 553; 285/356

[56] References Cited

U.S. PATENT DOCUMENTS

| | | | |
|---|---|---|---|
| 1,150,960 | 8/1915 | Peabody | 239/597 X |
| 1,804,814 | 5/1931 | Schultis | 285/358 X |
| 1,817,854 | 8/1931 | Sorensen . | |
| 1,858,136 | 5/1932 | Brenner . | |
| 2,463,883 | 3/1949 | Kinsey . | |
| 2,469,851 | 5/1949 | Stecher et al. | 285/356 X |
| 2,618,511 | 11/1952 | Whalin | 239/550 X |
| 2,925,224 | 2/1960 | Cunningham | 239/600 X |
| 3,092,904 | 6/1963 | MacWilliam | 285/356 X |
| 3,930,298 | 1/1976 | Ridenour . | |
| 4,200,314 | 4/1980 | Ridenour . | |
| 4,660,773 | 4/1987 | O'Hanlon | 239/600 X |

FOREIGN PATENT DOCUMENTS

| | | |
|---|---|---|
| 23033 | 4/1918 | Denmark . |
| 83712 | 7/1953 | Norway . |
| 227334 | 10/1925 | United Kingdom . |
| 480395 | 2/1938 | United Kingdom . |

*Primary Examiner*—Andres Kashnikow
*Assistant Examiner*—Kevin P. Weldon
*Attorney, Agent, or Firm*—Fay, Sharpe, Beall, Fagan, Minnich & McKee

[57] ABSTRACT

A gas tube assembly includes a first cylindrical metal gas supply tube terminating in a first end. An annular coupling nut with a central opening receives the first end of the tube and has a cylindrical counterbore which extends axially inward of the central opening about the first end of said tube. The counterbore terminates in a transversely extending shoulder. A radially outward extending circumferential bead formed integrally with the tube is located within the counterbore adjacent the first end of the tube and is positioned in engagement with the transversely extending shoulder. Connected to the tube is a gas burner orifice nozzle having an inlet end with a transverse end face and an axially extending throughbore. The throughbore has an inlet end which receives the first end of the tube. An outer terminal end of the nozzle defines a gas outlet orifice which is substantially smaller in diameter than the diameter of the bore at the inlet end. A circumferential exterior portion of the nozzle about the inlet end is threadedly received in the coupling nut with the end face sealingly engaging the bead.

2 Claims, 2 Drawing Sheets

BURNER NOZZLE ASSEMBLY

BACKGROUND OF THE INVENTION

The subject invention is directed to the gas burner art and, more particularly to an improved assembly for releasably joining a burner orifice nozzle to a gas supply tube.

The burner orifice nozzle assembly of the subject invention is intended to be used on gas cooking ranges as a burner tube assembly and will be described with reference thereto; however, the invention is capable of broader application and could be used in other environments.

The typical burner tube assembly used in gas cooking ranges generally has the gas supply tube joined to the orifice fitting or nozzle in one of several different manners. One commonly used joining method is to stake or press fit the end of the supply tube into a specially drilled or bored cavity in the fitting. Another method is to braze the supply tube to the fitting. A third method involves using compression nuts and ferrules or loxit type nuts.

When a fixed orifice or a coaxial orifice is used with either a stake joint or a brazed joint, two gas connections must be made. One of these connections is the tube to the orifice holder and the other is the orifice to the orifice holder.

When a fixed or coaxial orifice is used with a compression nut and ferrule or a loxit type nut, three gas connections or sealing points must be made. The first sealing area is the ferrule to the tube, the second is the ferrule to the orifice holder, and the third is the orifice to the orifice holder.

Since safety is of paramount importance in the assembly of a gas appliance, the elimination of potential gas leak connections is extremely desirable.

It will be shown that this invention will accomplish the connection of a tube to an orifice holder and the connection of an orifice to the orifice holder with only one gas connection and still allow the orifice to be removed and/or replaced in the field.

SUMMARY OF THE INVENTION

In accordance with one aspect of the subject invention, there is provided a gas burner tube assembly which includes a gas supply means including a first cylindrical metal supply tube which terminates in a first end. An annular coupling nut with a central opening is received about the first end of the tube. The coupling nut has a cylindrical counterbore which extends axially inward of the central opening about the first end of the tube member and terminates in a transversely extending shoulder. Formed integrally with the tube and extending radially outward circumferentially thereabout is a bead member which is located within the counterbore adjacent the first end of the tube member and positioned in engagement with the transversely extending shoulder. A generally cylindrical gas burner orifice nozzle with an inlet end having a transverse end face and an axially extending throughbore is joined to the coupling nut. The bore of the orifice nozzle has an inlet end which receives the first end of the tube member. The throughbore has an outer terminal end defining a gas outlet orifice substantially smaller in diameter than the diameter of the bore at the inlet end. A circumferential exterior portion of the nozzle about the inlet end is threadedly received in the coupling nut with the end face clamped into sealing engagement with the bead circumferentially thereabout.

In accordance with a more limited aspect of the invention, the bead includes first and second opposed end surfaces with the first surface extending generally parallel to and in engagement with the transversely extending shoulder in the coupling nut. Preferably, the second opposed end face is inclined toward the first opposed end surface and sealingly engages the end face of the nozzle in a narrow, circumferentially continuous band.

In accordance with a more limited aspect of the invention, it is preferred that the angle of the second opposed end face be at approximately 45° relative to the first opposed end surface and the axis of the nozzle. Additionally, it is also preferred that the second opposed end surface engage the end face of the nozzle at the juncture of the end face of the nozzle and the throughbore. It is also preferred that this juncture have a generally convex shape so as to generate both radial and axial components of sealing force with the bead surface.

Additional aspects of the invention include the provision of replaceable outlet orifice defining means on the burner orifice nozzle itself. These orifice defining means can be internally mounted inserts or externally mounted caps threadedly connected to the outlet end of the burner nozzle to facilitate changeover between natural gas and propane.

As can be seen from the foregoing, a primary object of the invention is the provision of a burner orifice nozzle assembly wherein the burner orifice nozzles may be readily changed and disconnected from the gas supply pipes with a minimum of difficulty.

A still further object is the provision of a replaceable orifice nozzle for a gas burner assembly wherein sealing is achieved through the use of a particular bead configuration on the gas supply pipe.

A further object is the provision of a gas burner tube assembly of the type described wherein the nozzle itself can be readily changed to allow changeover from natural to propane gas.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED AND ALTERNATE EMBODIMENTS

Figure 5:
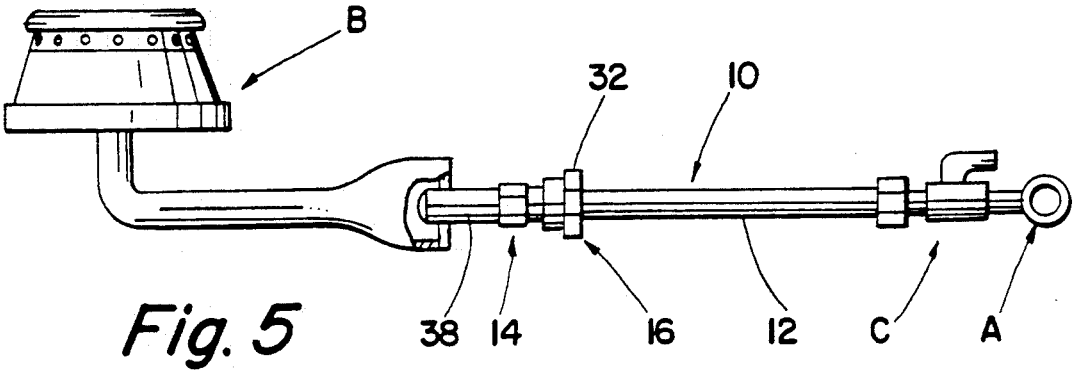

Referring more particularly to the drawings wherein the showings are for the purpose of illustrating preferred and alternative embodiments of the invention only, and not for the purpose of limiting same, FIG. 5 shows a typical gas burner supply arrangement to which the subject invention is applicable. Broadly, the arrangement shown includes a gas supply manifold A which joins to a burner B through a manual gas valve C and a gas burner tube assembly 10. As shown, the tube assembly 10 supplies gas to the venturi tube of the burner B.

Figure 1:
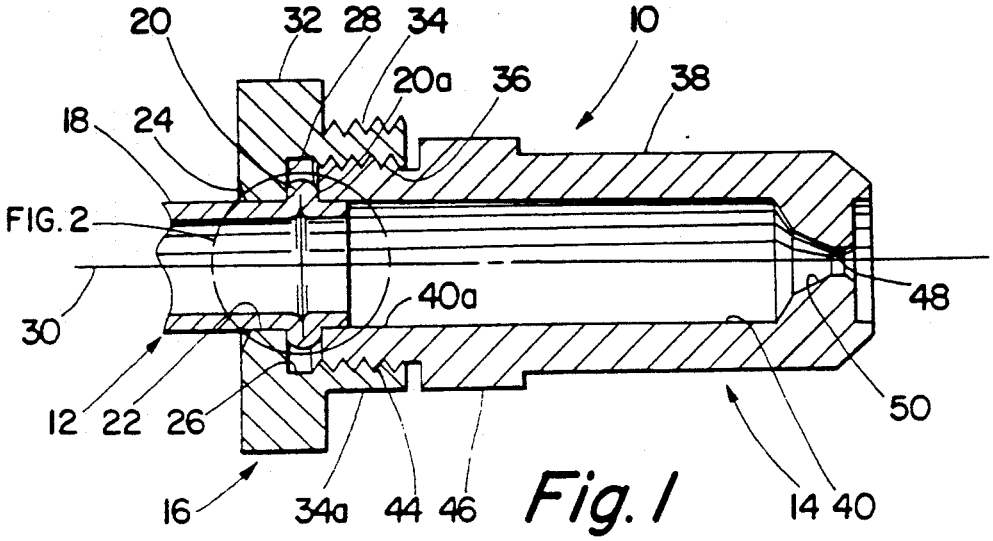
FIG. 1 is a longitudinal cross-sectional view through a gas burner tube assembly formed in accordance with a preferred embodiment of the subject invention.

FIG. 1 shows in detail the burner tube assembly 10 which generally comprises a gas supply tube 12 having a burner orifice nozzle element 14 releasably connected therewith by a coupling nut 16. As noted earlier, this assembly is particularly intended for use as a burner tube assembly for cooking ranges and the gas is supplied to the assembly through the tube 12 which is generally a small diameter aluminum tube which terminates in a free end 18 about which is integrally formed a radially outwardly extending sealing bead 20. The bead 20 is formed axially inward of a short pilot length portion 19 which acts to locate the tube 12 in the nozzle element 14 and assure proper alignment of the bead 20 with the associated structure.

The preferred conformation of sealing bead 20 will subsequently be described with particular reference to FIG. 2. For the present, however, it should be noted that bead 20 is formed integrally from the parent metal of the tube 12 using conventional metal forming techniques including well known axially driven die forming techniques. These particular forming methods and techniques form no part of the invention.

The coupling nut 16 is formed from any suitable metal, such as aluminum, steel, or brass, and generally comprises a relatively short body having an opening 22 extending axially therethrough and sized so as to closely receive the tube end 18 in the manner illustrated. Preferably, opening 22 has a chamfer 24 about its inlet end. The right-hand or outlet end of opening 22 is counterbored as shown at 26, and there is a radially extending clamping shoulder 28 at the bottom of the counterbore 26. Preferably, the shoulder 28 is circumferentially continuous and extends in a plane generally perpendicular to the longitudinal axis 30 of the supply tube 12 and the burner orifice nozzle 14. Desirably, stepped diameter outer surface portions 32 is provided with a non-circular shape, such as a hex shape, for receiving a wrench or the like for facilitating joining and releasing the burner orifice nozzle 14. Outer portion 34 is threaded but provided with a flat **34*a* to facilitate assembly in the appliance in which it is installed. It should be further noted that the interior of the counterbore 26 is provided with suitable internal threads 36**.

The burner orifice nozzle 14 is an elongated, generally cylindrical rigid body 38 which has a throughbore 40 extending axially therethrough. The nozzle can be formed from any suitable metal or ceramic material capable of withstanding the temperatures involved. The throughbore 40 has an inlet end **40*a* which is sized so as to closely receive the terminal end of tube 12. A sealing end face 42 extends generally perpendicular to the longitudinal axis 30 and engages the right-hand end surface 20*a* of bead 20. The exterior of the left-hand or inlet end of nozzle 14 is provided with threads 44 which cooperate with the internal threads 36 to allow the nozzle 14 to be clamped to bring surface 42 into sealing engagement with the bead 20*a***.

In order to allow the nozzle 14 to be firmly tightened into engagement with the coupling nut 32, there is preferably a non-circular tool receiving portion 46 formed on the body 38. The portion 46 can have a hex configuration or the like.

The outlet end of the through passage 40 is provided with a reduced diameter orifice portion 48 which is sized so as to be suitable for use as a burner orifice nozzle and the size is dependent upon whether or not the burner orifice nozzle is to be used for natural gas or propane. In the embodiment shown, the orifice 48 preferably has a diameter of approximately 0.055 inches and the conical surface 50 is preferably at an angle of approximately 30° relative to the axis 30, and the outlet portion of the orifice 48 has a 45° corner break or chamfer formed thereon. The arrangement thus far described allows quick and ready removal of the burner orifice nozzle 14 from the supply tube 12 so that different orifice nozzle sizes can be readily substituted depending upon whether the particular burner is to be supplied with liquified petroleum gas or natural gas.

Figure 2:
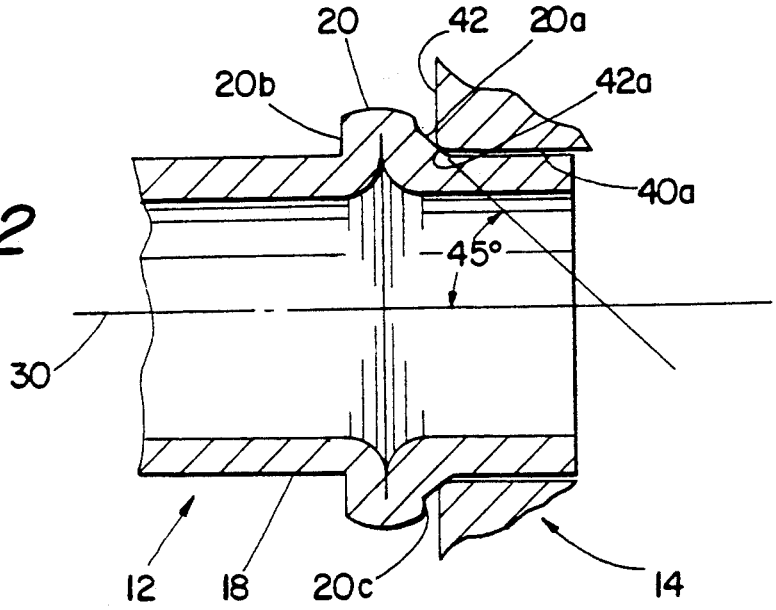
FIG. 2 is an enlarged cross-sectional view of the circled area of FIG. 1 showing the sealing relationship between the supply tube bead and the orifice nozzle end face.

FIG. 2 shows the preferred shape or cross-sectional configuration of the bead 20. As shown therein, the left-hand end face **20*b* of the bead 20 is preferably flat and perpendicular to the axis 30 for engagement with the flat perpendicular bottom 28 of the counterbore 26. This allows significant axially directed clamping forces to be applied to the bead 20 to drive it into sealing engagement with the sealing end face 42 of nozzle 14. The right-hand or sealing surface 20*a* of bead 20 is, however, preferably formed so as to have a conical shape as shown in FIG. 2 with the sealing surface lying at an angle of approximately 45° relative to the longitudinal axis 30. In addition, the radial outer end of the surface 20*a* joins with a surface 20*c* which is generally flat and perpendicular to the central axis 30**.

It is preferred that the juncture between the inlet portion **40*a* of bore 40 and the end surface 42 be convex or rounded as shown at 42*a*. This convex portion preferably has a radius of a few thousandths of an inch such that when the components are clamped together, the sealing forces have both radial and axial component and a wedging action generally takes place between the surface 42*a* and 20*a***.

Figure 3:
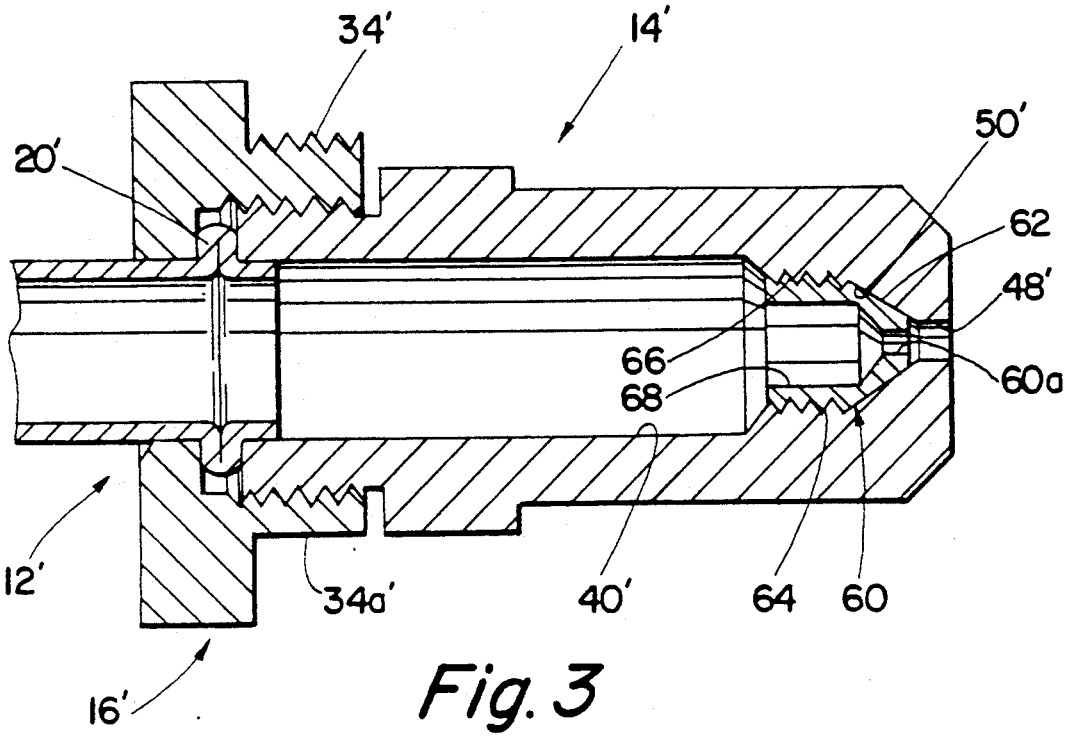
FIGS. 3 and 4 are longitudinal cross-sectional views through two additional embodiments showing gas orifice nozzles having removable orifice defining components; and, FIG. 5 is a somewhat diagrammatic showing of a gas burner supply arrangement.
Figure 4:
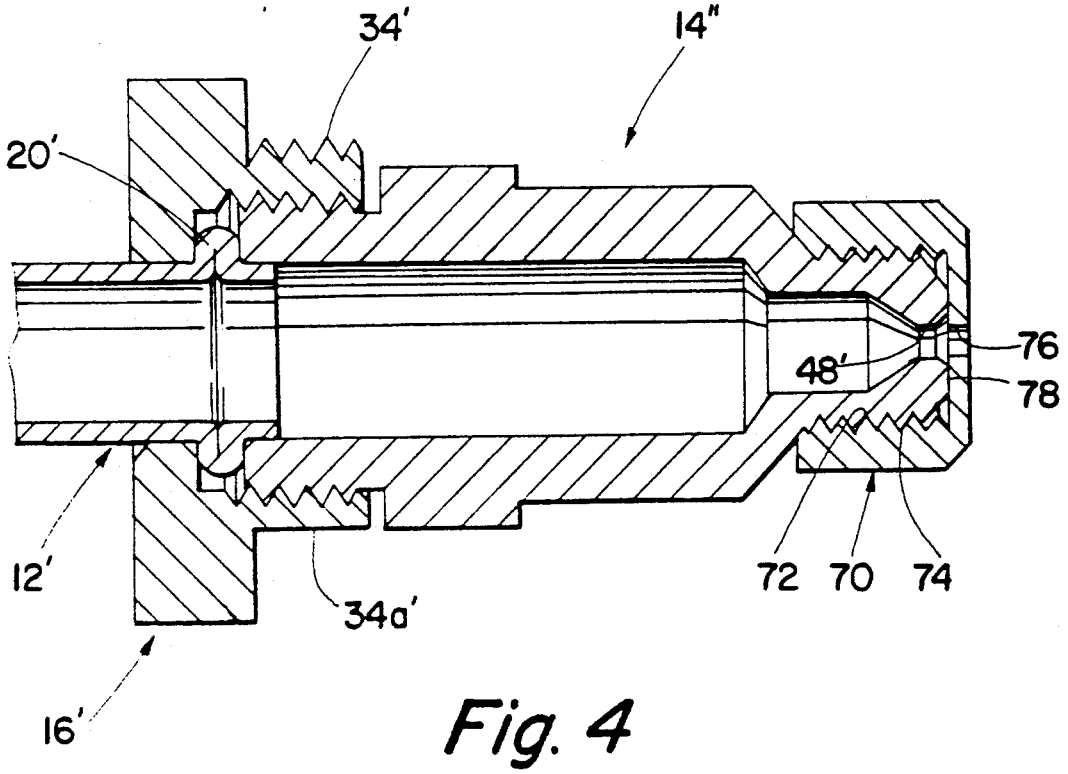

FIGS. 3 and 4 show slightly modified arrangements for the nozzle of the subject invention. In each of the FIGS. 3 and 4 embodiments, the elements which correspond to those of the FIG. 1 embodiment have been identified with the same reference numerals differentiated from the FIG. 1 embodiment by a prime suffix. The new elements are identified with new reference numerals. Referring particularly to the embodiment shown in FIG. 3, this embodiment has a modified form for the outlet or discharge end of the orifice nozzle 14'. In particular, the nozzle is provided with a removable insert element 60 arranged so as to allow the diameter of the outlet orifice to be readily changed so that it can allow the nozzle to function either for natural gas when the insert is removed or for liquified petroleum gas (LPG) when desired. The insert 60 has a generally cylindrical shape with a truncated, conical end configuration as shown at 62 for engagement with the internal surface 50' to seal therewith. The angle of the conical end configuration 62 is slightly different than the angle of surface 50' to assure that sealing engagement takes place about the axial outermost end of insert 60. For example, the insert's conical end makes an angle of 27-½° with the center axis while surface 50' is at a 30° angle.

The exterior portion 64 of the insert 60 is threaded and arranged to be received in corresponding internal threads 66 formed about the interior of the internal passageway 40'. Preferably, the internal opening 68 within the insert 60 is formed with a hex configuration to allow the insert to be placed in and removed from nozzle 14' through the use of a hex-shaped wrench, such as an Allen wrench. It should be appreciated that the outlet orifice 60a is sized so as to be suitable for the gas which is to be supplied through the burner.

The embodiment of FIG. 4 shows a second way in which a quick changing of the orifice size can be carried out. In this embodiment, a nozzle cap member 70 is arranged to be threadedly connected to the outer end of the nozzle element 14'. For this reason, the interior of cap 70 is threaded as shown at 72 and corresponding exterior threads 74 are formed on the exterior of the nozzle as shown. Preferably, the exterior of the cap 70 is provided with wrench flats or a hexagonal shape to allow the use of a wrench or suitable tool to apply the cap to the nozzle body. The orifice 76 through the nozzle cap 70 is likewise arranged and sized for a particular gas to be supplied through the nozzle. In order to assure a seal between the cap 70 and the nozzle element 14', the end of the nozzle at face 78 is formed at a slight angle so that sealing contact takes place about inner periphery.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A gas burner tube assembly comprising:

a gas supply means including a first cylindrical tube member terminating in a first end;

an annular coupling nut having a central opening through which the first end of said tube member extends, said coupling nut having a cylindrical counterbore which extends axially inward of said central opening about the first end of said tube member and terminates in a transversely extending shoulder;

a radially outward extending circumferential bead formed integrally with the tue and located within the counterbore adjacent the first end of the tube member and positioned in engagement with the transversely extending shoulder;

a generally cylindrical gas orifice nozzle having an inlet end with a transverse end face and an axially extending throughbore, said bore having an inlet end receiving the first end of the tube member, said throughbore having an outer terminal end defining a gas outlet orifice which is substantially smaller in diameter than the diameter of the bore at the inlet end, a circumferential exterior portion of the nozzle about the inlet end being threadedly received in the coupling nut with the end face sealingly engaging the bead;

said bead further including first and second opposed end surfaces with the first end surface extending generally parallel to and in engagement with the transversely extending shoulder in said coupling nut, the second opposed end surface being inclined toward the first opposed end surface at an angle of 45° relative thereto and sealing engaging the end force of the nozzle in a narrow circumferentially continuous band.

2. A gas burner tube assembly comprising:

a gas supply means including a first cylindrical tube member terminating in a first end;

an annular coupling nut having a central opening through which the first end of said tube member extends, said coupling nut having a cylindrical counterbore which extends axially inward of said central opening about the first end of said tube member and terminates in a transversely extending shoulder;

a radially outward extending circumferential bead formed integrally with the tube and located within the counterbore adjacent the first end of the tube member and positioned in engagement with the transversely extending shoulder;

a generally cylindrical gas orifice nozzle having an inlet end with a transverse end face and an axially extending throughbore, said bore having an inlet end receiving the first end of the tube member, said throughbore having an outer terminal end defining a gas outlet orifice which is substantially smaller in diameter than the diameter of the bore at the inlet end, a circumferential exterior portion of the nozzle about the inlet end being threadedly received in the coupling nut with the end face sealingly engaging the bead, said bead further including first and second opposed end surfaces with the first end surface extending generally parallel to and in engagement with the transversely extending shoulder in said coupling nut and the second end surface being inclined at an angle of 45° to the axis of the nozzle and engaged with the juncture between the transverse end face and the inlet end of the throughbore of the nozzle.

* * * * *